US005773796A

United States Patent [19]

Singer et al.

[11] Patent Number: 5,773,796

[45] Date of Patent: Jun. 30, 1998

[54] HEATED ROLLER ASSEMBLY

[75] Inventors: Karl Singer, Barrington Hills; Robert Allen Crimmins, Algonquin; Lawrence B. LeStarge, Elgin, all of Ill.

[73] Assignee: D&K Custom Machine Design, Inc., Elk Grove Village, Ill.

[21] Appl. No.: 799,875

[22] Filed: Feb. 13, 1997

[51] Int. Cl.[6] ..... G03G 15/20

[52] U.S. Cl. ..... 219/470; 219/216; 399/333; 399/334

[58] Field of Search ..... 219/216, 469–471; 399/380–335; 432/60, 228; 492/46; 118/60

[56] References Cited

U.S. PATENT DOCUMENTS

| | | | |
|---|---|---|---|
| 3,720,808 | 3/1973 | Morrissey | 219/469 |
| 4,064,933 | 12/1977 | Schuman | 219/469 |
| 5,300,996 | 4/1994 | Yokoyama et al. | 219/216 |
| 5,485,260 | 1/1996 | Mitsuya | 399/330 |
| 5,596,397 | 1/1997 | Shimada et al. | 399/335 |

FOREIGN PATENT DOCUMENTS

| | | |
|---|---|---|
| 57-29065 | 2/1982 | Japan . |
| 60-55368 | 3/1985 | Japan . |
| 5-173451 | 7/1993 | Japan . |
| 8-335002 | 12/1996 | Japan . |

*Primary Examiner*—Teresa J. Walberg
*Assistant Examiner*—J. Pelham
*Attorney, Agent, or Firm*—Wallenstein & Wagner, Ltd.

[57] ABSTRACT

A heated roller assembly (10) is disclosed having a thermal conductive shell (21) with an inner surface (22) and an outer surface (23). A plurality of parallel, annularly spaced apart heat pipes (31) are positioned within longitudinal channels (25) provided along the outer surface of the core (21). A thermal conductive ceramic putty or ceramic (51) overlays the heat pipes (31) and is contoured to be flush with the outer surface (23) and prevent damage to the heat pipes (31) during the turning process. An electric (17,18) heater (41) is secured to the inner surface (22) of the shell (21). End caps (15) and axle(s) (16) contain and support the assembly (10), respectively. The core (21)/pipe (31) assembly is encased in an outer sleeve (55) with a non-stick functional surface (61).

22 Claims, 2 Drawing Sheets

HEATED ROLLER ASSEMBLY

DESCRIPTION

1. Technical Field

The present invention relates generally to a heated roller assembly, and more particularly, to an electrically heated roller incorporating a plurality of annularly spaced apart separate heat conducting pipes.

2. Background of the Invention

There are numerous applications for heated rollers. Heated rollers are used in laminating machines, printing presses, photocopy machines and computer printers. An important aspect in these applications is the physical construction of the actual rollers.

In particular, it is almost always desired for the entire circumference of the roller to have a uniform temperature. If the ends of the roller exterior or contact surface are hotter than the center of the roller exterior or contact surface, the work product can be heated unevenly. This can result in a less-than-perfect end product. This problem is particularly acute when the entire longitudinal width of the exterior surface of the roller does not contact the work, e.g., film, sheet board, paper or substrate. In short, the work has a smaller width than the roller. In such circumstances, only a portion of the roller will contact the work. For example, a 36" (width) roller laminating a 24" (width) film will have 12" of unused width. This will, at times, cause uneven heating of the work as the work contacts the roller.

Moreover, obtaining and maintaining proper temperature of the external surface of the roller can be both difficult and inefficient. It has been found in some systems, that if a temperature, say 250 degrees, is desired, the ends of the roller may need to be continuously heated to 350 degrees. Thus, as the heat is depleting or dissipating in the center section of the roller, where the work is located and the load placed on the roller, the heat from the end sections of the roller are replenishing the center section.

Many attempts have been made to ensure even distribution of heat to both the heating roller and the final product. In some applications, the roller is heated using a closed-loop heat exchanger system. For example, heated oil or water is pumped through tubes, axially disposed through the length of the roller. Heat is transferred from the tubes to the outer surface of the roller via an internal path. Problems exist, however, with these type of systems. Oil systems can leak and thus contaminate the roller assembly and product passing over the roller. In addition, it has been found that such system's efficiency is low.

Another method used in some applications to heat a roller is by conducting electricity through an outer surface of the roller. An electrically conductive layer (formed by ceramic layering techniques or heater pads) 15 uniformly applied to the outer surface of the roller to improve the conduction and heat generating capabilities of the roller. An external conductive element, electrically connected to an external power supply, contacts the conductive layer of the roller. The connection is normally made near the ends of the roller. Electricity is then supplied to the conductive layer via the conductive element. A resistance in the conductive layer generates heat, thus providing a heated roller.

SUMMARY OF THE INVENTION

The present invention is an improvement on many of these past systems and is believed to solve many of these and other problems.

A heated roller assembly is disclosed herein that includes a cylindrical (tubular) shell or core having a plurality of annularly spaced apart parallel longitudinal channels formed in the outer surface of the shell. Each of these channels has a channel depth. The longitudinal channels are equally, annularly spaced apart and the shell is preferably a heat conductive metal and more specifically aluminum.

An elongated heat pipe is secured within each of the channels. Each of these heat pipes has a pipe diameter equal to or less than the channel depth. The heat pipes are tubular and circular in cross section. Each pipe comprises: opposed closed ends to form a vessel; a vacuum within the vessel; a working fluid therein; and, a wick therein to move the working fluid.

Each heat pipe within the channels is also covered with a ceramic heat conductive material and the outer surface of the ceramic is milled, turned or ground to be flush with the outer surface of the shell to form a continuous cylindrical outer surface.

A heater of a silicone rubber/fiberglass is bonded to the inner surface of the shell. In the alternative, a plurality of elongated longitudinal heater rods are secured in auxiliary, parallel, equally spaced apart longitudinal channels.

A heat conducting (e.g., metal) cylindrical sleeve is placed over and around the continuous outer surface of the roller. This sleeve is either polished (i.e., polished chrome) so as to minimize friction thereon or, in the alternative, a functional layer is laid over the sleeve. This functional layer is preferably a low friction material to minimize friction over the surface, such as teflon or ceramic.

End caps are provided at opposed ends of the roller and are secured to the cylindrical sleeve. An axle extends outwardly from each end cap.

Electrical connection means, such as wire leads, for supplying electricity to the heater means is passed through an axle and end cap to the roller.

Other advantages and aspects of the present invention will become apparent upon reading the following description of the drawings and detailed description of the invention.

BRIEF DESCRIPTION OF THE DRAWINGS

In order that the present invention may be more fully understood, it will now be described by way of example, with reference to the accompanying drawings in which.

DETAILED DESCRIPTION OF THE PREFERRED EMBODIMENT

Figure 1:
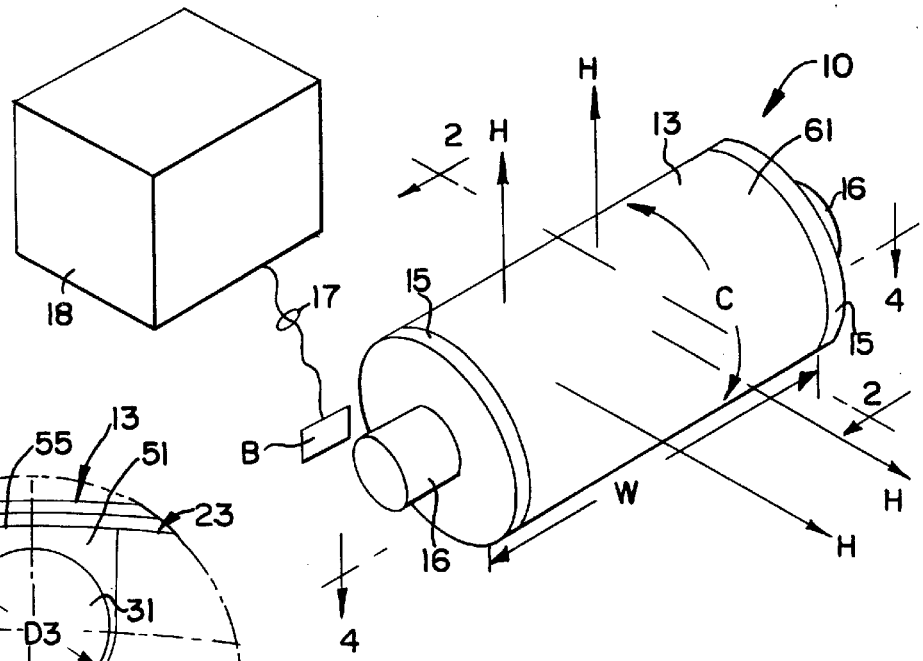
FIG. 1 is a perspective, schematic view of a heated roller assembly made in accordance with the present invention having a portion removed therefrom.

While this invention is susceptible of embodiment in many different forms, there is shown in the drawings and will herein be described in detail, some preferred embodiments of the invention with the understanding that the present disclosure is to be considered as an exemplification of the principles of the invention and is not intended to limit the broad aspect of the invention to the embodiments illustrated.

Referring to the drawings, FIG. 1 shows the heated roller assembly of the present invention, generally designated by the reference number 10. The heated roller assembly 10 generally includes a cylindrical roller 12, with an exterior, contact surface 13, opposed end caps 15, and an axle or shaft 16 passing entirely therethrough. A pair of outwardly extending opposed axles/shafts can also be attached to the end caps, as opposed to a single axle/shaft 16. One or more electrical leads 17 pass through a portion of the axle 16 to the power source 18. Typically, these leads connect via a conventional electrical coupler/bushing or brushes B to the power source 18; this permits rotation of the roller assembly while maintaining an electrical connection.

Figure 3:
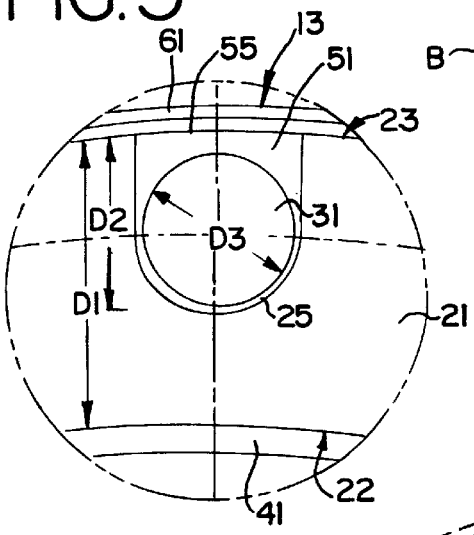
Figure 2:
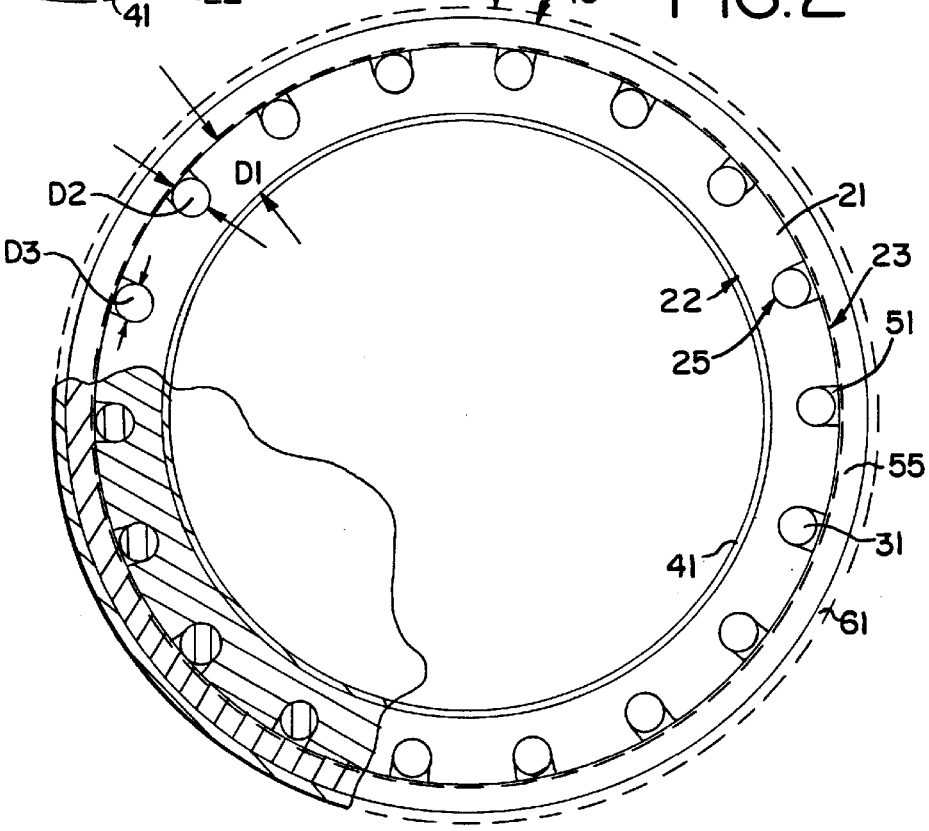
FIG. 2 is a cross-sectional [end] view (with only a portion thereof cross-hatched) along line 2—2 in FIG. 1; and, FIG. 3 is a detail enlarged view of the heat pipe and channel shown in FIG. 2.
Figure 4:
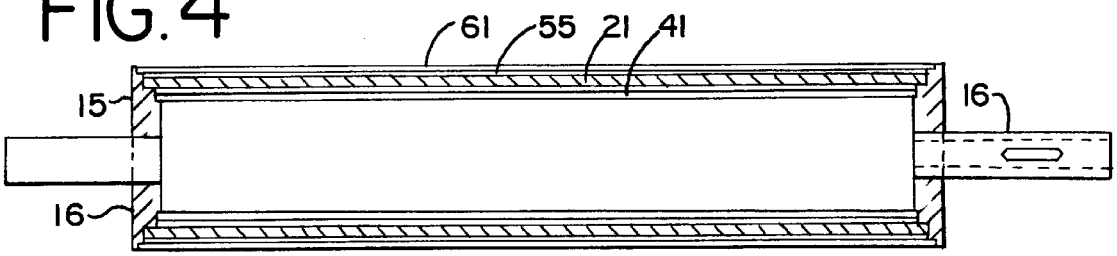
FIG. 4 is a cross-sectional [side] view along line 4—4 of FIG. 1.

As shown in FIG. 2, the cylindrical roller comprises a cylindrical shell or core 21. This core 21 preferably conducts heat quite well, such as a metal. In the preferred embodiment, aluminum is used to both conduct and transfer heat and because it is an excellent heat conductor. In addition, aluminum is relatively light in weight. The core 21 is hollow, having both an inner surface 22 and an outer surface 23. The radial distance between the inner 22 and outer 23 surfaces of the core 21 has a thickness, designated distance D1. A plurality of annularly spaced apart parallel and elongated longitudinal channels 25 are formed in the outer surface 23 of the core 21. Each of these channels 25 (FIG. 3) has a channel depth D2. The channel depth D2 is less than the thickness D1 of the shell or core 21.

An elongated heat pipe 31 is secured in the channels 25. Each pipe 31 has a pipe diameter D3 slightly less than the channel 25 depth D2. In this manner, the elongated pipe 31 can be easily placed and fitted into the channel 25. In addition, as exemplified in FIG. 3, a heat conducting putty 51, such as a ceramic or epoxy or equivalent, is placed over the pipe 31 and channel 25.

The heat pipes 31 (in channels 25) are preferably evenly spaced apart annularly around the core.

Figure 8:
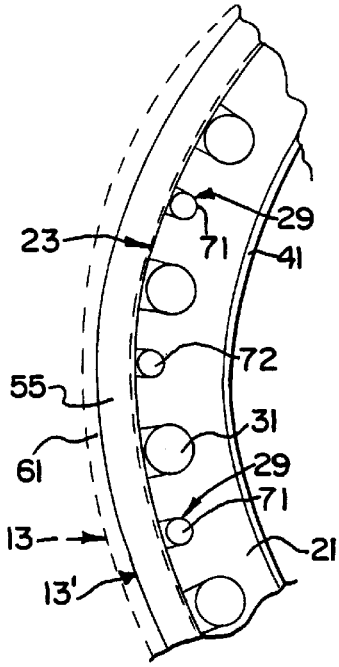

A heating element 41 is secured to the inner surface 22 of the shell 21 to heat the shell 21 and the pipes 31 therein. A heating element 71 may be constructed adjacent an outer surface of the roller also. Moreover, ancillary annular channels 29 parallel the pipe channels 25 can be constructed to hold either smaller diameter heating elements 71 (e.g., well-known electrical elements (rods) actually generating heat like the heating element 41) or sensors 72, well-known thermocouplers. (FIG. 8). A sleeve 55 is slid over the shell 21/pipe 31 assembly and a functional layer/surface 61 is layered, placed or coated to the outer surface of the sleeve 55. As noted previously, end caps 16 are secured to the sleeve 55. The details of the various components of the assembly 10 follow.

The primary purpose of the roller 10 is to conduct and maintain uniform heat (H) across the width (W) and circumference (C) of the roller (FIG. 1). In addition, immediate recovery (moving heat to areas in need of further heat), power efficiency (the cost of heating and maintaining the heated roller) and energy efficiency (minimum amount of heat lost or wasted) are important considerations. For these reasons, the core/shell 21 is preferably aluminum. In the example illustrated, the core has an outside diameter (DO in FIG. 5) of 8 inches and an inside diameter of 6½ inches (DI in FIG. 5). The preferred heat pipes 31 are constructed primarily of copper.

Figure 7:
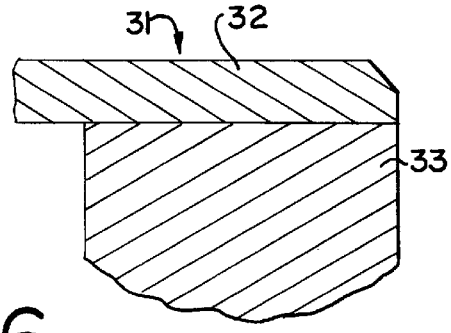
FIG. 7 is a detail of the end portion of the heat pipe shown in FIG. 6; and, FIG. 8 is an end view of an alternative embodiment.
Figure 6:
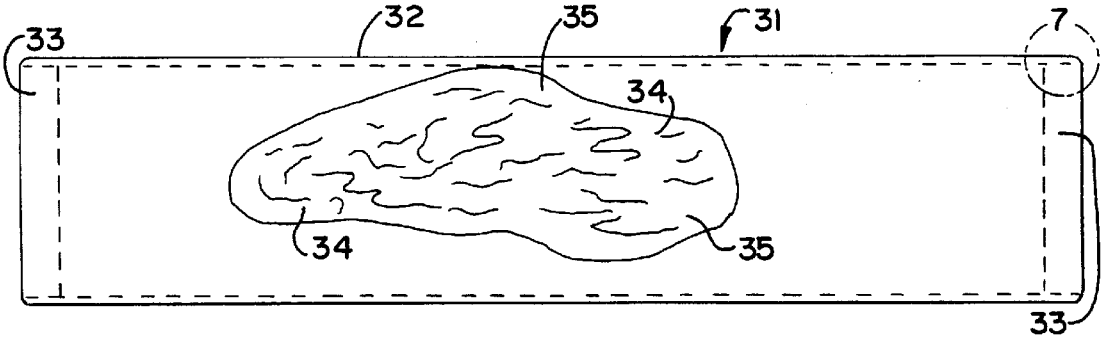
FIG. 6 is a schematic side view with a broken-away sectional view therein of a heat pipe.

Turning to FIGS. 6 and 7, a heat pipe 31 is shown in detail. The heat pipe is a heat transfer device, as opposed to a heat generating device, with an extremely high effective thermal conductivity. It comprises an elongated tubular (substantially circular in cross section) vessel wall 32, closed by stops 33 or other equivalent means at both ends. In manufacturing, a working fluid 34 is placed into the vessel along with a wick 35 before subjecting the vessel to a vacuum within and sealing the pipe. Accordingly, the fluid 34 and the wick 35 are maintained in the sealed vessel 32,33 under vacuum.

A suitable heat pipe 31 is manufactured and sold by Thermacore, Inc., 780 Eden Road, Lancaster, Pa. 17601, under the trademark THERMAL-CORES. These self-contained heat transfer systems are totally passive and transfer heat from a heat source to a heat sink with minimal temperature gradients, or to isothermalize surfaces. As explained by the manufacturer, the heat pipes transfer heat by evaporation and condensation of the working fluid. The pipe is, after all, a vacuum tight vessel which is evacuated and partially back-filled with a working fluid. The heat pipe has no moving parts. As heat is input at the evaporator, fluid is vaporized, creating a pressure gradient in the pipe. This pressure gradient forces the vapor to flow along the pipe to the cooler section where it condenses, giving up its latent heat of vaporization. The working fluid is then returned to the evaporator by capillary forces developed in the porous wick structure or by gravity.

Working fluids range from Helium and Nitrogen for cryogenic temperatures, to liquid metals, such as Sodium and Potassium, for high temperature applications. More common working fluids are ammonia, water, acetone and methanol. The internal pressure of the pipe is at saturation pressure of the fluid at the corresponding fluid temperature. Consequently, the pipe is designed so the working fluid boils at any temperature above its freezing point.

In the embodiment illustrated, eighteen (18) channels 25 are shown. They are annularly spaced at 20 degrees (center to center) from one another. Eighteen (18) copper pipes 31 are used. The preferred outside diameter D3 of the pipes 31 is about ⅜ inches. As a result, the channel 31 depths D2 are greater than ⅜ inches.

A heat conductive putty 51 is layered/placed over the heat pipe 31 within the channel 25. This putty 51 is preferably heat conducting ceramic or epoxy or the equivalent. In particular, a suitable putty 51 is manufactured and sold by Aremco Products, Inc., P.O. Box 429, Ossining, N.Y. 10562-0429, under the trademark PYRO-PUTTY™ Industrial Process & Repair Compounds. These putties are a family of ceramic and epoxy based compounds used for sealing, patching, coating, and bonding metals and refractories used in high temperature abrasive and corrosive atmospheres. Such applications are found in the foundry, aerospace, power generation, heat treating, and automotive industries. The prototypes constructed incorporated PYRO-PUTTY Compound Nos. 656 (Epoxy) 1000 (Ceramic). PYRO-PUTTY Compound No. 656 (Epoxy) has a major constituent of Alumina. It is alleged to be high strength, corrosion and wear resistant, alumina-filled epoxy and adheres well to ceramics, metals, plastics and glass. It is used one-to-one mix ratio with option cure schedules. The maximum temperature for the product is 400° F. and it has a specific gravity of 1.8 gms/cc, a CTE of 3.8 in/in° F., a moisture resistance rated excellent, an oxidation resistance rated excellent, a solvent resistance rated excellent, a thermal shock resistance rated excellent and an acid resistance rated excellent. The number of compounds used is two and the color is an off white. PYRO-PUTTY Compound No. 1000 (Ceramic) has a major constituent of Aluminum. It is aluminum filled, hi-temp, thixotropic putty alleged to be ideal for sealing and patching aluminum castings used in the automotive and industrial repair markets. The maximum temperature for the product is 1400° F. and it has a specific gravity of 1.8 gms/cc, a CTE of 10.0 in/in° F., a moisture resistance rated good, an oxidation resistance rated good, a solvent resistance rated good, a thermal shock resistance rated excellent and an acid resistance rated good. The number of compounds used is two and the color is grey.

A conductive outer sleeve 55 made of steel, aluminum, stainless steel, chrome or plated steel, is placed over the core 21, pipes 31 and putty 51 to hold the roller together structurally. Either this outer sleeve 55 itself is plated (i.e., chrome plated) [shown as contact surface 13'] or a functional surface 61 is placed thereover. The function surface 61 [contact surface 13] is shown in phantom lines in FIGS. 2 and 8.

The functional surface/layer 61 placed or coated to the outer sleeve 55 is preferably a non-stick substance, such as teflon or ceramic. A suitable surface 61 is manufactured and sold by Micro Surface Corporation, P.O. Box 788, 465 East Briscoe Drive, Morris, Ill. 60450, under the trademark MICROLON™ 3300 Spray On Coating. This product is a blend of fluorocarbon lubricants in an organic resin binder and solvent system designed for applications beyond the scope of conventional fluorocarbon coatings. Its low coefficient of friction, hardness, adhesion, resiliency and cure conditions allow applications in a multitude of pure sintered PTFE coatings are unsuitable. These coatings are alleged to wear longer than pure PTFE, offer superior chemical resistance and can be repaired without removing the existing coating. This coating also claims to combine the toughness of the support resin with the surface properties of pure PTFE. Its physical properties include a color of black, coefficient of friction of 0.09 static and 0.09 kinetic, continuous service temperature of 400° to 45° F. and intermittent service temperature of 500° F., an ASTM D968-51 Sand Abrasion Test of 21 liters/mil, a Hartman Wear Test of 200,000 cycles (180 lbs. test load), a Taber Abrasion Test weight loss of 16.9 mg/1,000 cycles, a Humidity test of 986 humidity at 120° F. and a ASTM B117-64 Salt Spray Test of 500+ hours at 5% concentration. In addition, the material is a thin film of 0.001 to 0.0015 inches and it can be overcoated.

As noted above, if desired, one or more additional ancillary or auxiliary annular channels 29 in the core 21 can be used to house a thermocouple, thermostat and/or temperature sensor (71,72). A thermostat can transmit the sensed temperature to a display for manual adjustment of the heater 41 or to a control for automatic adjustment of the heater. Such channels can further support an active heating element (not shown) as opposed to a passive heat pipe. One or more annular heating elements (well known to those skilled in the art) can supplant or supplement the heating element 41 shown in the figures.

The heater or heating element shown 41 is preferably a fiberglass reinforced silicone rubber flexible heater. A suitable heater 41 is manufactured and sold by Electro-Flex Heat, Inc., Northwood Industrial Park, P.O. Box 88, Bloomfield, Conn. 06002-0088, under the trademark ELECTRO-FLEX. These flexible heating elements 41 consist of precisely shaped patterns of resistance alloy, either wire or etched foil, laminated between thin layers of high temperature insulation material.

The details of constructing the assembly 10 follow.

Figure 5:
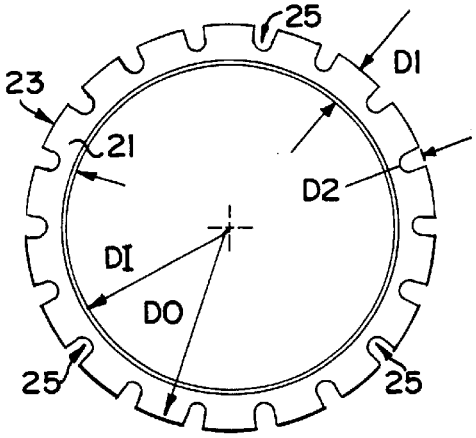
FIG. 5 is a side view of a core or shell prior to assembly.

Turning to FIG. 5, the shell 21 is first made to an outer diameter a little greater than the roller's finished size. The channels 25 are next machined into the shell. The pipes are placed into the channels and sealed by putty 51 within the channels. Because the pipe diameters D3 are less than the channel depths D2, putty will always cover the pipes. The shell with the pipes in place and sealed is machined turned to the desired outside diameter. Thus, the covering putty, as opposed to actual pipes, will be cut during turning, avoiding any damage. In short, the ceramic heat conductive material covering the pipes within the channels is shaped/cut so the ceramic's outer surface is flush with the outer surface of the shell to form a continuous cylindrical outer surface.

The silicone rubber heater 41 is cut to fit the inside of the shell 21, that being the same width as the shell and a length equal to the circumference of the inside diameter of the shell. The heater is next applied directly by bonding to the shell or by pressure sensitive adhesive. In addition (FIG. 8), heating rods/elements 71 can be positioned into auxiliary annular channels 29. The outer sleeve 55 is secured over the shell 21 and the pipes 31. Next, the end caps 15 are secured to the sleeve 55 with the leads 17 for the heater 41 running through an axle 16. The leads are physically connected to an electrical, modular connector, or conventional brush system B, and connected to the power source 18.

While the invention has been described with reference to some preferred embodiments of the invention, it will be understood by those skilled in the art that various modifications may be made and equivalents may be substituted for elements thereof without departing from the broader aspects of the invention. The present examples and embodiments, therefore, are illustrative and should not be limited to such details.

We claim:

1. A heated roller assembly comprising:

a cylindrical shell having a plurality of annularly spaced apart parallel longitudinal channels formed in an outer surface of the shell, the channels each having a channel depth;

an elongated heat pipe secured in at least some of the channels, each pipe having a pipe diameter equal to or less than the channel depth;

a heater means attached to the shell;

an electrical connection means for supplying electricity to the heater means.

2. The heated roller of claim 1 wherein the shell is tubular with an inner surface and the heater means is attached to the inner surface of the shell.

3. The heated roller of claim 2 wherein the heater means is a silicone rubber/fiberglass heater bonded to the inner surface of the shell.

4. The heated roller of claim 1 wherein the shell is comprised of aluminum.

5. The heated roller of claim 1 wherein the plurality of annularly spaced apart parallel longitudinal channels are equally annularly spaced apart.

6. The heated roller of claim 1 wherein each heat pipe within a channel is covered with a ceramic heat conductive material, the outer surface of the ceramic being shaped to be flush with the outer surface of the shell to form a continuous cylindrical outer surface.

7. The heated roller of claim 1 wherein a functional layer is laid over the continuous outer surface of the roller.

8. The heated roller of claim 1 wherein a cylindrical sleeve is placed over and around the continuous outer surface of the roller.

9. The heated roller of claim 8 wherein the sleeve is polished so as to minimize friction thereon.

10. The heated roller of claim 8 wherein a functional layer is laid over the sleeve.

11. The heated roller of claim 10 wherein the functional layer is one of either teflon or ceramic.

12. The heated roller of claim 1 further including end caps at opposed ends of the roller and an axle extending outwardly from each end cap, the electrical connection means for supplying electricity to the heater means passing through at least one axle.

13. The heated roller of claim 1 wherein each heat pipe is tubular and circular in cross section and comprises:

opposed closed ends to form a vessel;

a vacuum within the vessel;

a working fluid therein; and, a wick therein to move the working fluid.

14. A heated roller assembly comprising:

a cylindrical core having an inner surface and an outer surface and a plurality of equal, annularly spaced apart parallel longitudinal channels formed in the outer surface, the core thickness being the radial distance between the inner surface and the outer surface and the channels having a channel depth less than the core thickness;

an elongated heat pipe secured in at least some of the channels, each pipe having a pipe diameter equal to or less than the channel depth;

a heater means attached to the core; and, an electrical connection means for supplying electricity to the heater means.

15. The heated roller of claim 14 wherein the heater means is attached to the inner surface of the core and the heater means is a silicone rubber/fiberglass heater bonded to the inner surface of the core.

16. The heated roller of claim 14 wherein the core is comprised of a metal and each heat pipe within a channel is covered with a ceramic heat conductive material, the outer surface of the ceramic being shaped to be flush with the outer surface of the core to form a continuous cylindrical outer surface.

17. The heated roller of claim 14 further including a functional layer of either teflon or ceramic formed over the continuous outer surface of the roller.

18. The heated roller of claim 14 wherein a cylindrical sleeve is placed over and around the continuous outer surface of the roller.

19. The heated roller of claim 18 wherein the sleeve is polished so as to minimize friction thereon.

20. The heated roller of claim 18 wherein a functional layer is laid over the sleeve.

21. The heated roller of claim 14 further including end caps at opposed ends of the roller and an axle extending outwardly from each end cap, the electrical connection means for supplying electricity to the heater means passing through at least one axle.

22. The heated roller of claim 14 wherein each heat pipe is tubular and circular in cross section and comprises:

opposed closed ends to form a vessel;

a vacuum within the vessel;

a working fluid therein; and, a wick therein to move the working fluid.

* * * * *